US006155188A

United States Patent [19]

Henze et al.

[11] Patent Number: 6,155,188

[45] Date of Patent: Dec. 5, 2000

[54] DEVICE FOR MECHANICALLY TURNING OVER A LONGITUDINAL EDGE OF A CONTINUOUS FABRIC WEB

[75] Inventors: Siegfried Henze, Hohenroth; Elmar Schmitt, Grossbardorf, both of Germany

[73] Assignee: Texpa Maschinenbau GmbH & Co., Germany

[21] Appl. No.: 09/350,732

[22] Filed: Jul. 9, 1999

[30] Foreign Application Priority Data

Jul. 20, 1998 [DE] Germany ..... 198 32 536

[51] Int. Cl.[7] ..... D05B 35/04

[52] U.S. Cl. ..... 112/141

[58] Field of Search ..... 112/141, 147, 112/153, 139, 136, 137

[56] References Cited

U.S. PATENT DOCUMENTS

| | | | |
|---|---|---|---|
| 1,850,152 | 3/1932 | Vigne | 112/137 |
| 1,864,503 | 6/1932 | Maier | 112/136 |
| 1,884,271 | 10/1932 | Sailer | 112/147 X |
| 1,971,118 | 8/1934 | Mueller | 112/141 |
| 2,279,588 | 4/1942 | Enos | 112/141 |
| 2,282,042 | 5/1942 | Enos | 112/141 |
| 3,142,277 | 7/1964 | Jordan . | |
| 5,441,002 | 8/1995 | Satoma . | |

FOREIGN PATENT DOCUMENTS

| | | |
|---|---|---|
| 1951985 C2 | 4/1970 | Germany . |
| 3047972 C3 | 7/1982 | Germany . |
| 3505170 A1 | 8/1986 | Germany . |

*Primary Examiner*—Ismael Izaguirre
*Attorney, Agent, or Firm*—McGlew and Tuttle, P.C.

[57] ABSTRACT

A device for mechanically turning over at least one longitudinal edge of a continuous fabric web is provided with a conveyor for conveying the fabric web in the direction of the longitudinal edge and at least one edge turning device (1). The edge turning device (1) has two guide elements (2, 3), which can each be applied to one side of the fabric web in the region of a longitudinal edge section. An inner guide element (2) includes a convex guide surface (14) and the outer guide element (3) includes a matching concave guide surface (15). The opposing guide surfaces (14, 15) of the two guide elements (2, 3) are arranged in the edge turning device (1) so as to form a gap (10), whose width is at least slightly larger than the thickness of the fabric web in the region of the longitudinal edges. As the fabric web is drawn through the gap (10), the longitudinal edge of the fabric web is turned over in the desired manner. In order to be able to vary the width of the gap (10) during the processing of fabric webs of different thicknesses, at least one of the guide elements (3) can be arranged in the edge turning device (1.) so that it is adjustable relative to the second guide element (2).

18 Claims, 5 Drawing Sheets

DEVICE FOR MECHANICALLY TURNING OVER A LONGITUDINAL EDGE OF A CONTINUOUS FABRIC WEB

FIELD OF THE INVENTION

The invention relates to a device for mechanically turning over at least one longitudinal edge of a continuous fabric web with a conveyor for conveying the fabric web in the direction of the longitudinal edge and at least one edge turning device.

BACKGROUND OF THE INVENTION

Devices of this type are used in particular, but by no means exclusively, in the mechanical square-edging of fabric webs. In order to turn over the longitudinal edge, the fabric web being folded over once or a number of times parallel to the longitudinal edge, the fabric web is conveyed, for example drawn, through an edge turning device in the direction of the longitudinal edge by means of a conveying device. Arranged in the edge turning device are two guide elements, which each come to rest against one side of the fabric web in the region of a longitudinal edge section. In other words, the two guide elements rest against the longitudinal edge from above and below, so that the fabric web slides along the guide surfaces in the region of the longitudinal edge as it is conveyed through the edge turning device and is thereby shaped, guided by the guide surfaces.

In order to attain the desired folding of the fabric web parallel to the longitudinal edge, the guide surface of the guide element abutting from the inside is convex and the guide surface of the guide element abutting from the outside is concave in construction. In this manner, the opposing guide surfaces form a gap, whose width is at least slightly larger than the thickness of the fabric web in the region of the longitudinal edges, so that this gap is filled in its cross section by the longitudinal edge of the fabric web and effects the turning over of the longitudinal edge during the conveyance of the fabric web through the edge turning device.

A disadvantage in these known devices is that it is only possible to process materials of like thickness using the known edge turning devices. Since the two guide elements of the known edge turning devices are rigidly secured, for example by being fixedly soldered to a support plate, the width of the gap is preset. However, in order to ensure disturbance-free processing of the fabric web, it is necessary for the surfaces of the fabric web to rest closely against both guide surfaces, which is the reason why with the known devices it is only possible to process materials whose thickness varies to a very small degree. If materials having different thicknesses are to be processed, then it is necessary in each case to replace the edge turning devices according to the material thickness.

SUMMARY AND OBJECTS OF THE INVENTION

It is the primary object of the present invention to provide a device of the generic type, in which it is possible to process fabric webs of different thicknesses without replacing the edge turning device.

According to the invention, a device is provided for mechanically turning over at least one longitudinal edge of a continuous fabric web. The device has a conveyor for conveying the fabric web in the direction of the longitudinal edge and at least one edge turning device, which comprises two guide elements, which can each be applied to one side of the fabric web in the region of a longitudinal edge section. The inner guide element comprising a convex guide surface and the outer guide element comprises a matching concave guide surface. The opposing guide surfaces of the two guide elements are arranged in the edge turning device so as to form a gap, whose width is at least slightly larger than the thickness of the fabric web in the region of the longitudinal edges. At least one guide element can be arranged in the edge turning device so that it is adjustable relative to the second guide element.

As a result of the adjustment of the guide element, it is possible to increase and decrease the gap between the guide elements as a function of the thickness of the fabric web. When adjusting the device according to the invention to a new material quality, the width of the gap is varied until a disturbance-free shaping of the longitudinal edge is attained. In this position, the two guide elements can be locked, for example securedly screwed to a support plate, in order to permanently secure the gap size. According to the invention, it does not matter if the two guide elements are adjustably mounted or if one guide element is rigidly secured and the second guide element is mounted so as to be adjustable relative to this rigidly secured guide element.

In principle, different gap shapes are conceivable, which allow for a disturbance-free turning over of the longitudinal edge. It is particularly preferable if, in known manner, the gap of the edge turning device essentially has the shape of a curved surface section of a frustum. The initially substantially flat longitudinal edge of the fabric web runs into the gap at the base of the frustum and is rolled inwards along the curved surface of the frustum as a result of the continuous decrease in the cone diameter, so that the fabric web at the outlet of the gap has the desired folding as a function of the gap geometry. If the turned-over region is to comprise more than one fold parallel to the longitudinal edge, it is advantageous to use gap geometries which are helically wound.

Dependent upon the shape of the two guide elements, there are different possibilities of mounting the guide elements so that they are adjustable relative to one another in order to allow for the desired change in the gap width. More particularly, where an edge turning device having a frustum-shaped guide gap is used, the adjustable guide elements should preferably be axially adjustable parallel to the central axis of the frustum. As a result of this type of relative adjustment of the two opposing guide surfaces, the geometry of the guide gap and therefore the desired shaping of the fabric web is substantially maintained, although the width of the gap can be increased or decreased proportional to the degree of adjustment.

The inner guide element should preferably be secured substantially rigidly in the edge turning device and the outer guide element should be mounted in the edge turning device so as to be axially adjustable.

Materials of different thicknesses can be processed in a device according to the invention, the respective optimal gap width of the device needing to be found when setting up the machine. If it is only possible to rigidly lock the adjustable guide element in one position, for example by tightening locking screws, then it is necessary to carry out operating tests with the guide element in different positions when setting up the device, until the optimal gap width is found by testing. A setting up procedure of this type is time-consuming and there is also a danger of the guide element being accidentally displaced from the adjusted position, for example by vibrations. It is therefore advantageous if the displaceably mounted guide element is elastically tensioned by a restoring device in the direction of the rigidly secured guide element and in the opposite direction to the conveying direction of the fabric web.

Following the introduction of the fabric web into the edge turning device, the fabric web is pressed against the elastically mounted guide device by the conveying movement and thereby forces the gap apart until the latter is completely filled by the fabric web. Consequently, it is no longer necessary to set up the device for different material thicknesses, since the correct gap width automatically results from the elastic mounting of the adjustable guide element. Since the counter pressure of the restoring device and the pressure of the fabric web are in equilibrium, the surfaces of the fabric web rest with a defined pressure upon the two guide surfaces.

A particularly simple and cost-effective possibility of constructing a restoring device consists in securing a tension spring with its ends indirectly or directly to the inner and outer guide elements. In this manner, the tension spring pulls the two guide elements elastically towards one another, so that the gap width is always formed which is required for receiving the fabric web and for the optimal double-sided guidance thereof.

In order to facilitate the introduction of the fabric web into the device according to the invention and on the other hand in order to rule out an excessive increase in the gap between the two guide elements, the adjustable guide element should be mounted so as to be adjustable between two end abutments. The first end abutment defines the smallest possible gap and prevents the two guide elements from contacting one another with their guide surfaces. The second end abutment defines the largest possible gap and thereby prevents an excessive migration of the displaceable guide element.

In order to ensure that the turned-over longitudinal edge is supported as long as possible from the inside by the edge turning device irrespective of the size of the adjusted gap and to thereby prevent an undesirable folding of the fabric web transversely to its longitudinal edge, the axial end of the inner guide element at the outlet of the edge turning device should project relative to the axial end of the outer guide element. As a result of this overhang of the inner guide element at the outlet, which is preferably at least so great that the inner guide element also projects relative to the outer guide element when the maximum gap size is adjusted, the fabric web is supported from the inside in the region of the turned longitudinal edge as far as a defined position.

The outer guide element can be constructed in a cost-effective manner as a bent guide plate, whose internal surface extends along the desired gap geometry and thus acts as a concave guide surface.

The inner guide element can be constructed in a particularly simple manner as a frustum, it being of no consequence whether this frustum is formed in one or more parts. The curved surface of the frustum acts as a convex guide surface.

In order to be able to introduce certain auxiliary components into the fabric web in the turned region of the longitudinal edge, for example in the case of the introduction of a rubber cord into a seam, the inner guide element should preferably comprise a continuous recess extending in the conveying direction of the fabric web. The auxiliary component can be introduced through the aperture of the recess at the inlet of the edge turning device. The auxiliary component is carried along by the surrounding fabric web at the aperture of the recess at the outlet of the edge turning device. Compressed air can be used, for example, in order to convey the auxiliary component through the recess.

The devices according to the invention can be particularly advantageously used in the mechanical production of squared edging. It is therefore advantageous to arrange a sewing device for securing the turned-over longitudinal edge in the device in the region downstream of the edge turning device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
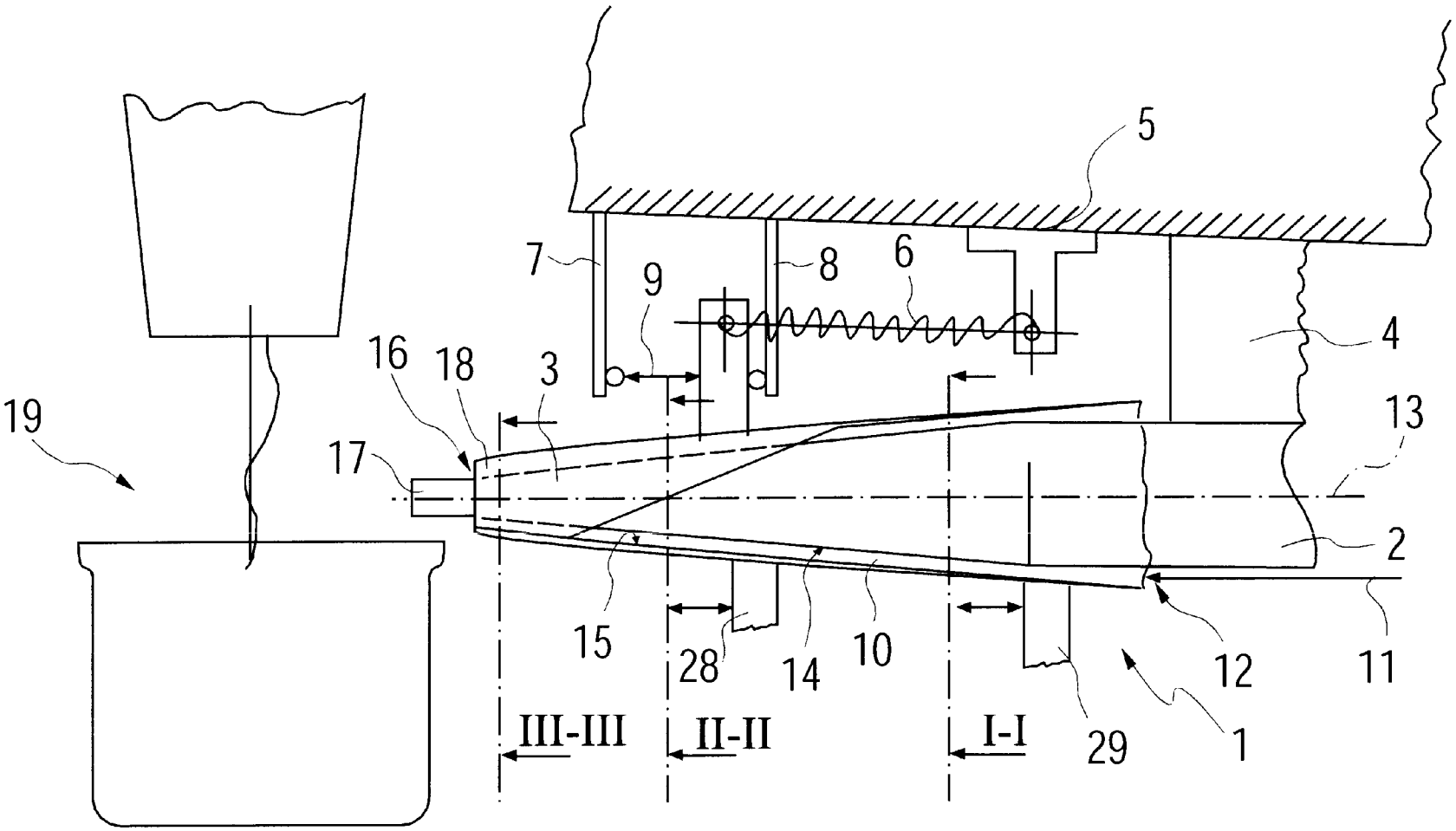
FIG. 1 is a schematic side view of a device according to the invention.

Referring to the drawings in particular, FIG. 1 shows a device according to the invention with an edge turning device 1, which comprises an inner guide element 2 and an outer guide element 3. The inner guide element 2 is rigidly connected to a support plate 5 via a retaining arm 4 shown in part. The outer guide element 3 is secured to the retaining arms 28 and 29 shown in part, which are axially displaceably mounted in a linear guide, not shown, and is tensioned towards the support plate 5 by means of a tension spring 6. Consequently, the outer guide element 3 can be axially displaced between the two end abutments 7 and 8 along the direction arrow 9, which extends parallel to the central axis 13.

Arranged between the inner guide element 2 and the outer guide element 3 is a gap 10, through which a longitudinal edge, not shown, of a fabric web can be drawn, so that the longitudinal edge is turned over in the edge turning device 1. To this end, the fabric web is introduced into the edge turning device 1 at the inlet 12 of the edge turning device 1 by a conveyor, not shown, is conveyed along the conveyor 11 and leaves the edge turning device 1 at the outlet 16 with a fold extending parallel to the longitudinal edge.

As a result of the axial adjustment of the outer guide element 3 parallel to the central axis 13 of the inner guide element 2, the width of the gap 10 between the opposing guide surfaces 14 and 15 can be increased or reduced.

As a fabric web is drawn through the edge turning device 1 according to the invention, the outer guide element is forced by the pressure of the fabric web resting against its inside in the direction of the outlet 16 of the device 1, until the compressive forces applied by the fabric web to the guide surface 15 are equal to the tensile force applied by the tension spring 6. If the tension spring is constructed with sufficient power, the two guide surfaces 14 and 15 consequently rest with a defined pressure upon the surfaces of the fabric web and the width of the gap 10 automatically adjusts to the thickness of the material which is to be processed. The largest and the smallest possible gap 10 is defined by the two end abutments 7 and 8.

At the outlet 16 of the edge turning device 1, the axial end 17 of the inner guide element 2 projects relative to the axial end 18 of the outer guide element 3, so that the turned region of the fabric web is supported from the interior as far as possible in order to prevent an undesirable fold formation.

Arranged downstream of the edge turning device 1 is a sewing device 19, schematically illustrated, by means of which the fabric web can be sewn in the region of the turned longitudinal edge in order to produce a seam.

Figure 2:
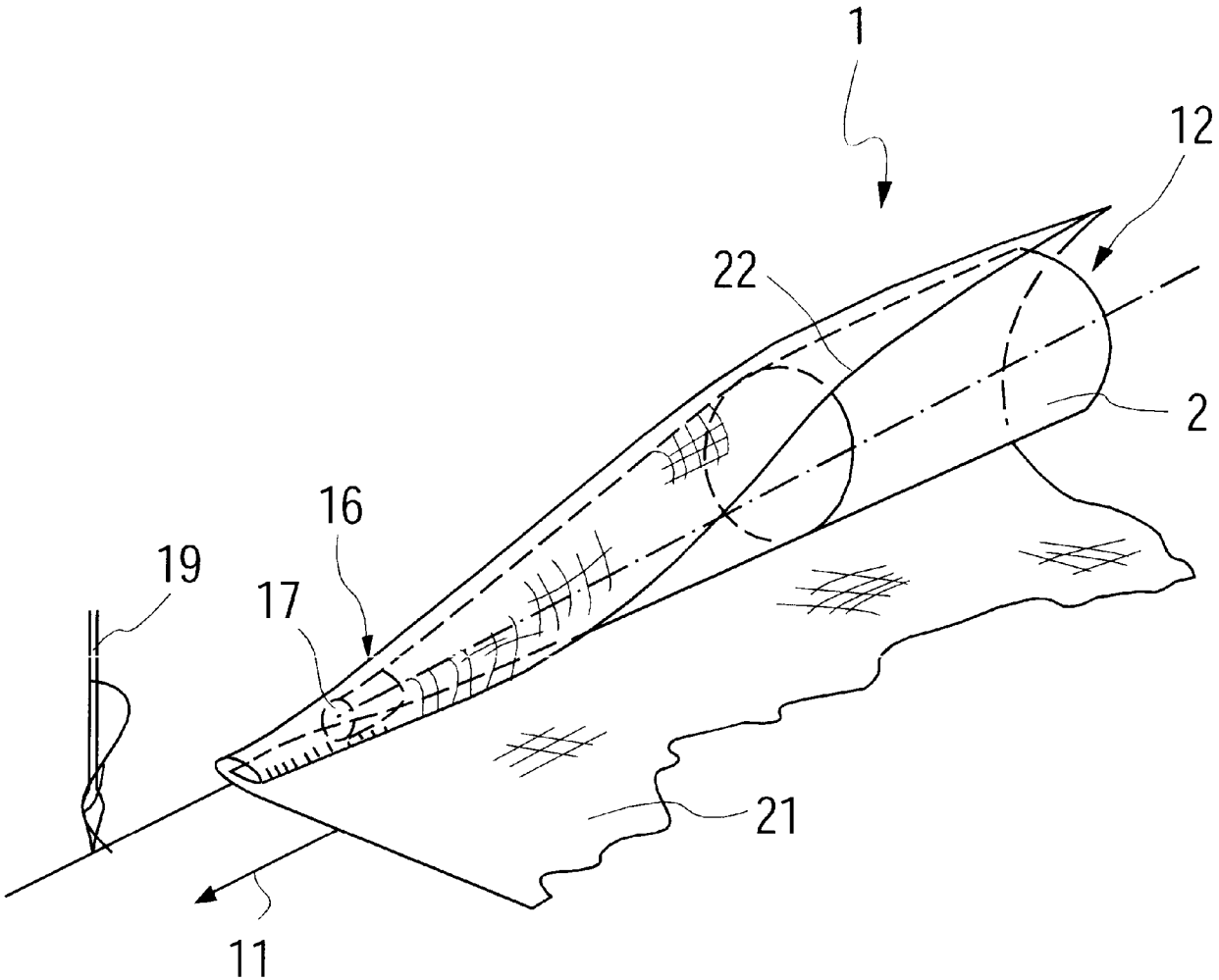
FIG. 2 is a perspective view of an edge turning process in a device according to the invention.

FIG. 2 shows the method of operation of a device according to the invention during the turning over of the longitudinal edge of a fabric web 21. Only the inner guide element 2 of the edge turning device 1 is illustrated for the sake of improved clarity. The fabric web 21 is conveyed according to the conveyor 11 from the inlet 12 to the outlet 16 of the edge turning device 1 and is thereby continuously turned over in the gap between the inner guide element 2 and the outer guide element 3, not shown. As a result, the fabric web 21 is folded double in the region of the longitudinal edge 22 at the outlet 16 of the edge turning device 1 and can be secured by means of the sewing machine 19.

Figure 3A:
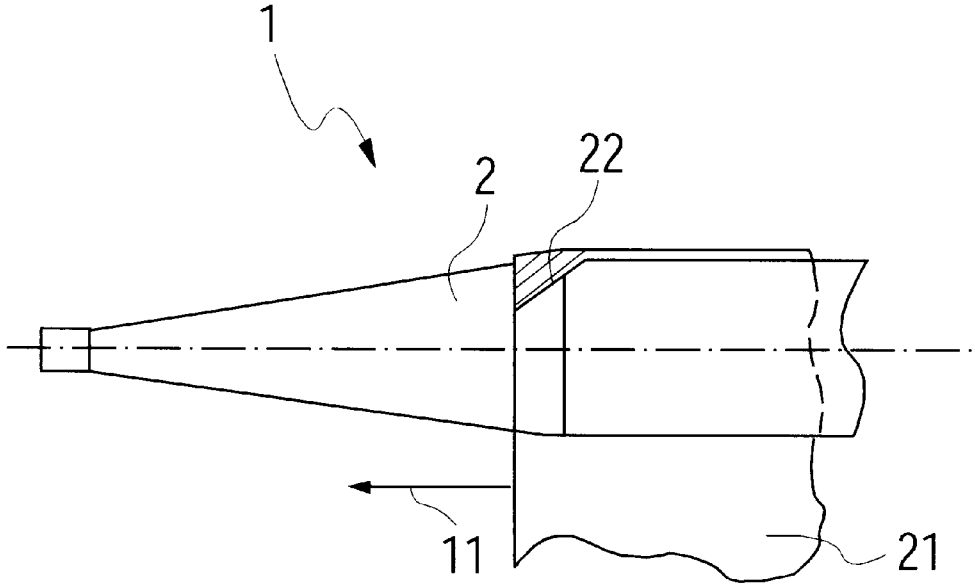
FIG. 3A is a top view of a state during an edge turning process in a device according to the invention.
Figure 3B:
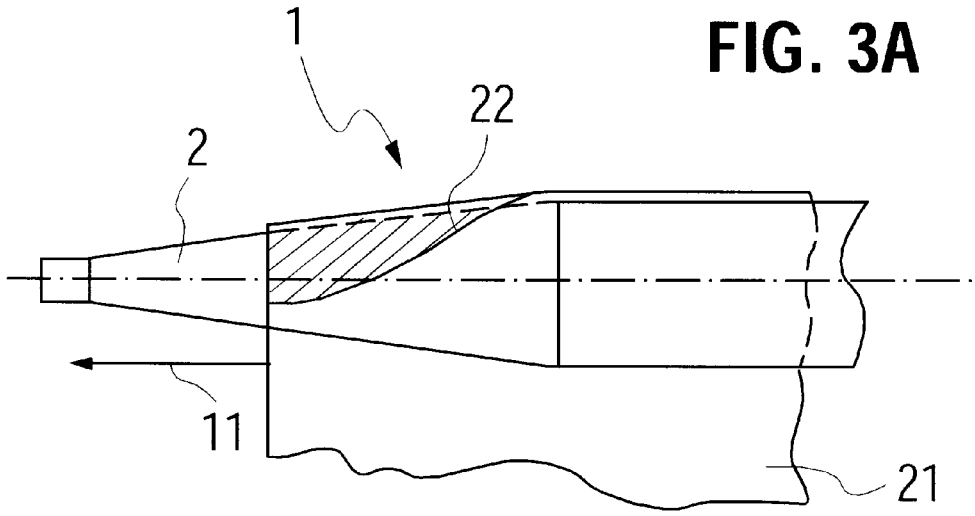
FIG. 3B is a top view of another state during the edge turning process in a device according to the invention.
Figure 3C:
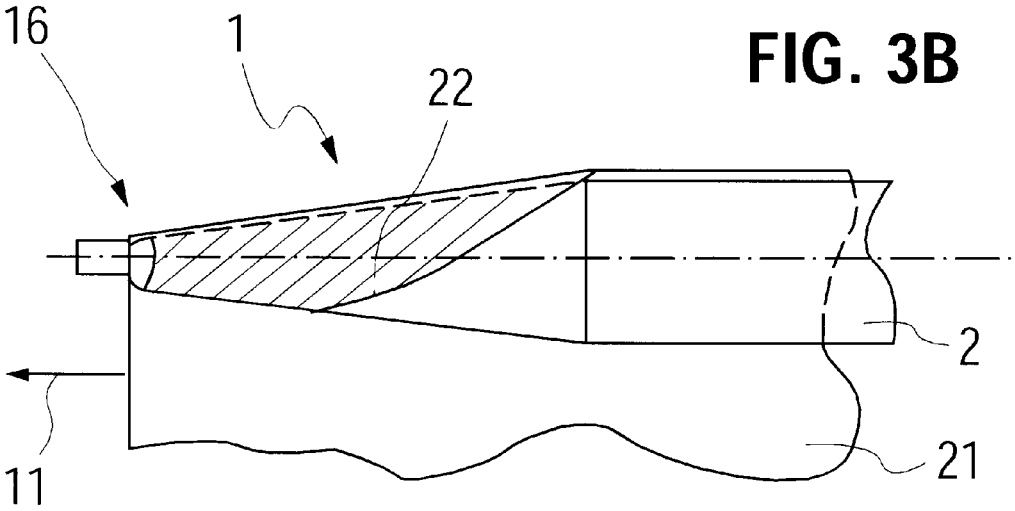
FIG. 3C is a top view of another state during the edge turning process in a device according to the invention.

FIG. 3A–3C show top views of the edge turning process during three different phases. Again, the outer guide element 3 is not shown for the sake of improved clarity. As it is drawn through the edge turning device 1, the longitudinal edge 22 of the fabric web 21 is guided along the gap between the inner guide element 2 and the outer guide element 3. The gap has the shape of a curved surface section of a helically wound frustum, so that the longitudinal edge 22 comes to wind helically around the inner guide element 2, resulting in a double-folded fabric section at the outlet 16 of the edge turning device 1.

Figure 4A:
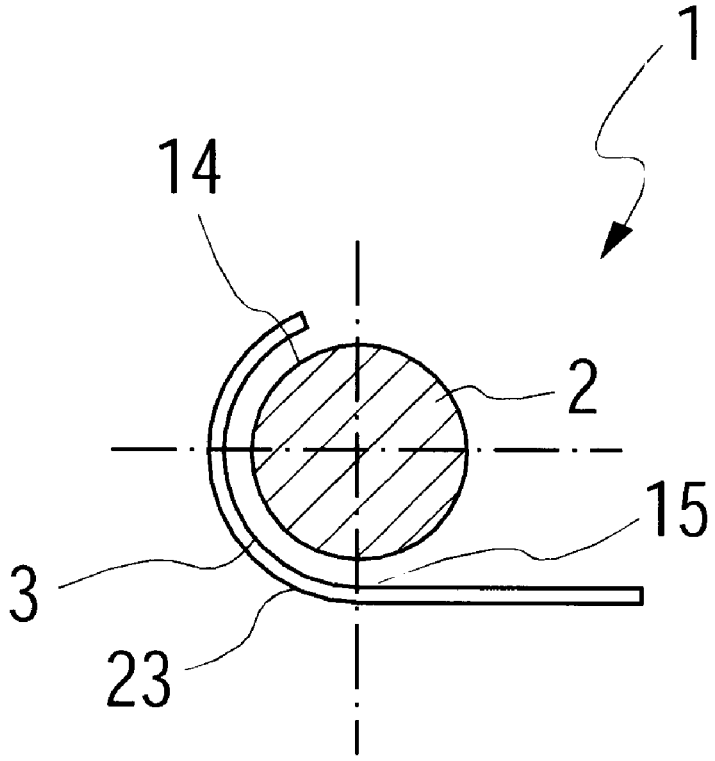
FIG. 4A is an edge turning device according to FIG. 1 showing a cross section.
Figure 4B:
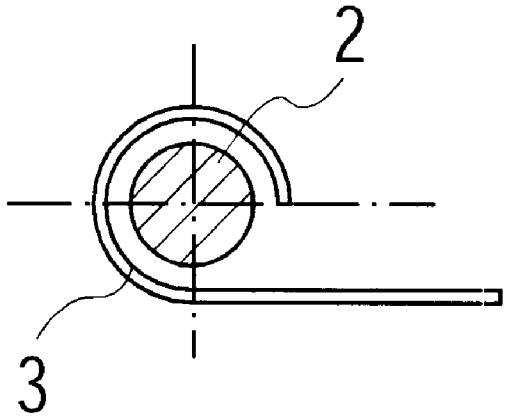
FIG. 4B is an edge turning device according to FIG. 1 showing another cross section.
Figure 4C:
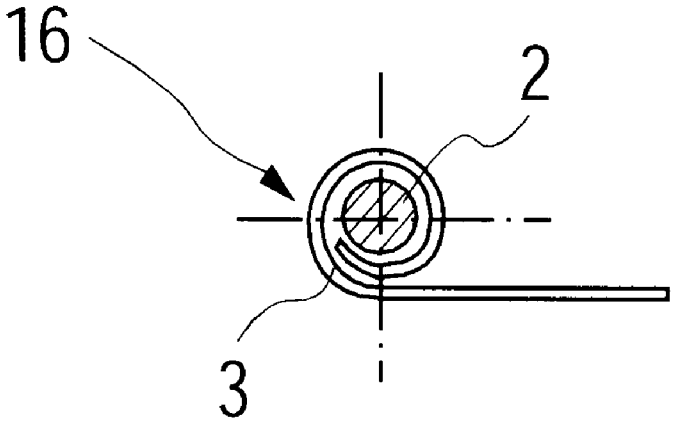
FIG. 4C is a n edge turning device according to FIG. 1 showing another cross section.

FIG. 4A–4C show three cross sections through the edge turning device 1 taken along the lines of intersection I—I, II—II and III—III respectively in FIG. 1. The diameter of the frustum-shaped inner guide element 2 decreases towards the outlet 16. The outer element 3 constructed as a bent guide plate 23 extends at a constant distance from the inner guide element 2, so that the gap 10 of constant width is formed between the guide surfaces 14 and 15.

Figure 5A:
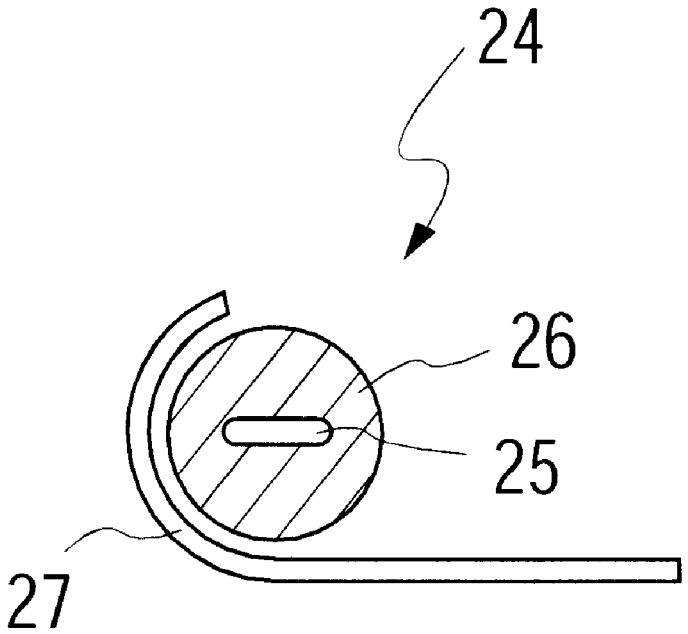
FIG. 5A is an edge turning device according to a second embodiment showing a cross section.
Figure 5B:
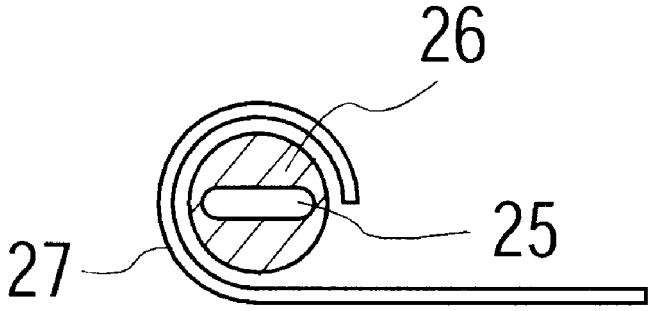
FIG. 5B is an edge turning device according to a second embodiment showing another cross section.
Figure 5C:
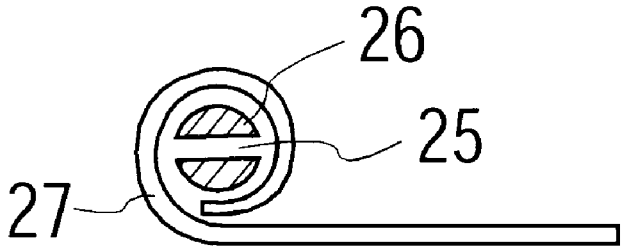
FIG. 5C is an edge turning device according to a second embodiment showing another cross section.

FIG. 5A–5C shows three cross sections through a second embodiment 24 of an edge turning device. Recognizable are the inner guide element 26 and the outer guide element 27, a continuous recess 25 extending in the central axis of the inner guide element 26, through which a rubber cord, for example, can be introduced into the turned longitudinal edge of a fabric web.

While specific embodiments of the invention have been shown and described in detail to illustrate the application of the principles of the invention, it will be understood that the invention may be embodied otherwise without departing from such principles.

What is claimed is:

1. A device for mechanically turning over at least one longitudinal edge of a continuous fabric web, the device comprising:

a conveyor for conveying the fabric web in the direction of the longitudinal edge;

an edge turning device including an inner guide element and an outer guide element, said two guide elements, said inner guide element and said outer guide element each being applyable to one side of the fabric web in the region of a longitudinal edge section, said inner guide element including a convex guide surface and said outer guide element comprising a matching element.

2. The device according to claim 1, wherein a gap of said edge turning device has, at least in sections, a shape of a curved surface section.

3. The device according to claim 2, wherein said gap of said edge turning device has a helically wound frustum shape.

4. The device according to claim 3, wherein said adjustable guide element is axially adjustable parallel to a central axis of said frustum.

5. The device according to claim 1, wherein said inner guide element is secured substantially rigidly and said outer guide element is axially adjustably mounted.

6. The device according to claim 1, further comprising a restoring device elastically tensioning said adjustable guide element in a direction of a rigidly secured guide element and in a direction opposite to a conveying direction of the fabric web of said conveyor.

7. The device according to claim 6, wherein said restoring device is a tension spring with ends connected indirectly or directly to said inner guide element and said outer guide element.

8. The device according to claim 1, further comprising two end abutments, wherein said adjustable guide element is adjustable between said two end abutments.

9. The device according to claim 1, wherein at the outlet of the edge turning device, an axial end of the inner guide element projects relative to an axial end of the outer guide element.

10. The device according to one of claim 1, wherein said outer guide element is constructed as a bent guide plate.

11. The device according to one of claim 1, wherein said inner guide element is constructed at least in sections in the manner of a frustum.

12. The device according to claim 1, wherein said inner guide element comprises means defining a continuous recess extending in the conveying direction of the fabric web.

13. A device according to one of claim 1, further comprising a sewing device arranged in a region downstream of the edge turning device.

14. A device for turning a longitudinal edge of a fabric, the device comprising:

an inner guide element receiving the fabric and guiding one side of the fabric against said inner guide element, said inner guide element including a convex guide surface;

an outer guide element positioned around said inner guide element and guiding another side of the fabric against said outer guide element, said outer guide element including a concave guide surface substantially complementary to said guide surface of said inner guide element, said inner and outer guide element guiding the fabric into a fold;

an adjustment element for linearly guiding a position of said outer guide with respect to said inner guide in a direction substantially parallel to the direction of the longitudinal edge.

15. The device in accordance with claim 14, wherein:

said adjustment element maintains said inner and outer guide elements substantially rotationally fixed with respect to each other.

16. The device in accordance with claim 14, wherein:

said adjustment element slides said outer guide with respect to said inner guide in said direction substantially parallel to the direction of the longitudinal edge.

17. The device in accordance with claim 14, further comprising:

a restoring device for biasing said outer guide element against said inner guide element.

18. The device in accordance with claim 14, wherein:

said outer guide element completely surrounds said inner guide element in a circumferential direction.

* * * * *